United States Patent [19]

Owen

[11] 4,192,502

[45] Mar. 11, 1980

[54] WRAPAROUND WEIGHTED EXERCISE DEVICE FOR THE FOOT AND ANKLE

[76] Inventor: Robert Owen, 49 Concord Ave., North Kingston, R.I. 02852

[21] Appl. No.: 932,775

[22] Filed: Aug. 11, 1978

[51] Int. Cl.[2] ..... A63B 23/04

[52] U.S. Cl. ..... 272/119; 280/11.37 E

[58] Field of Search ..... 128/166, DIG. 15; 272/119, 143, 96; 280/11.37 E

[56] References Cited

U.S. PATENT DOCUMENTS

| | | | |
|---|---|---|---|
| 3,334,898 | 8/1967 | McCrory | 272/119 |
| 3,525,141 | 8/1970 | Smith | 272/119 X |
| 3,528,652 | 9/1970 | Tarbox | 272/119 |
| 3,534,957 | 10/1970 | Norman | 128/166 X |
| 3,582,067 | 6/1971 | Rucks | 272/119 |
| 3,888,245 | 6/1975 | Berntson | 272/143 X |
| 4,085,746 | 4/1978 | Castiglia | 128/166 |

*Primary Examiner*—Richard J. Johnson

[57] ABSTRACT

A flexible V-shaped weighted exercising device having a flattish configuration defining opposite sides and wrapable about the foot and ankle. The device comprising a pair of flexible legs meeting at an apex area and each of said legs having a free end portion spaced from said apex area by a flexible, elongated, compartmentalized enclosure. Granule or particle weight materials received within the enclosure of each leg. Fastening structures disposed on each side of the end portion of one said leg and on opposite sides of the other end portion of said other leg and the apex area. The device adaptable to be interchangeably worn on either the right or left foot whereupon the weighted enclosure of one said leg is disposed about the ankle and weighted enclosure of the other said leg is disposed about instep and lateral aspect of the foot.

12 Claims, 7 Drawing Figures

FIG. 3
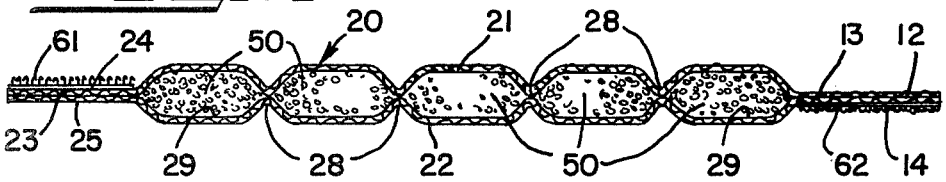
FIG. 4
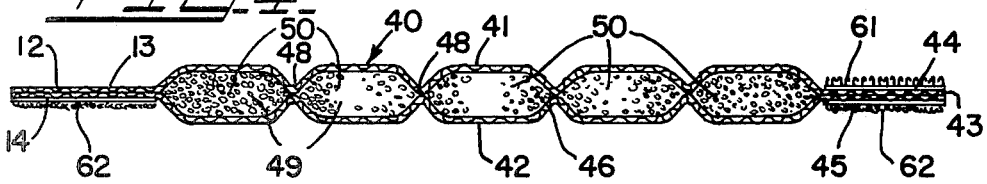
FIG. 5
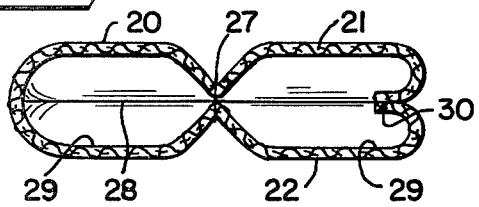
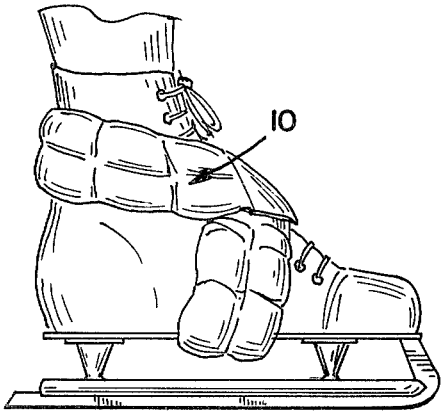
FIG. 6a
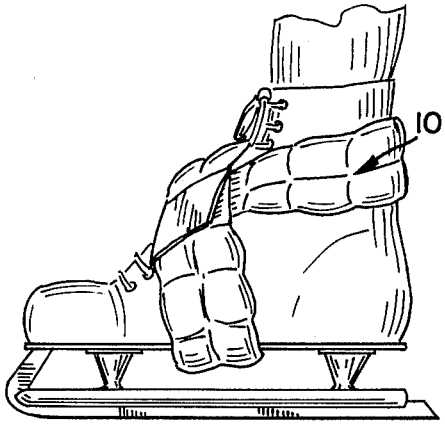
FIG. 6b

WRAPAROUND WEIGHTED EXERCISE DEVICE FOR THE FOOT AND ANKLE

BACKGROUND OF THE INVENTION

The instant invention relates to a therapeutic exercising device particularly adaptable for providing resistance and balance exercise for skaters and the like.

Heretofore there have been various type of weighted exercising articles which either were secured about the ankle or disposed directly below the foot of a wearer by mounting the same on the foot or skate. However, some such devices have specific uses and are not adaptable for use on structures other than ice skates. Others only provide weight about the ankle itself. Furthermore, each such article or device provides only limited resistance exercise to the leg, foot or ankle of the wearer.

SUMMARY OF THE INVENTION

The present invention overcomes the above-mentioned and other shortcomings by providing a flexible weighted exercising device or article which easily secures about the foot and ankle of a wearer in such a manner that weight is disposed about the ankle joint and the medial and lateral aspects of the foot.

The instant device has a V-shape configuration comprising a pair of flattish, flexible elongated members of substantially the same length meeting at one end thereof at a common apex section. The other end of each leg has an end section. Both the apex and each end portion sections have a substantially flat configuration defining oppositely disposed surface areas. Each leg is constructed in such a manner that a plurality of enclosed pockets or pouches are formed between the apex section and each end portion section of each leg. During fabrication of the device each pocket is caused to retain granular weighty material such as lead shot or the like. The pockets are filled with this material to the extent that each has a bulging yet flattish general configuration in order that each leg remains flexible and easily wraps about and conforms to the contour of the foot and ankle of the wearer.

The device is releasably secured and fastened in place by releasably engaging hook or burr and fibrous members, such as Velcro materials. These members or materials are disposed and secured on each oppositely disposed surface area on the end section of one leg, on one of the surface areas of the apex section and on the surface area of the end section of the other leg which is opposite that surface area of the apex section on which such material is affixed. Upon the device being positioned and secured in place upon the foot and ankle, the apex and the end sections of each leg align at the anterior portion of the foot such that the fastening member or materials affixed to the device are positioned in removable engagement with each other.

The instant invention wraps about the foot and ankle and is secured thereon in such a manner that weight is disposed about the ankle joint and the instep and lateral aspect of the foot of a wearer. The weight about the ankle provides resistance exercise to the large muscle groups of the hip and knee joints. While at the same time the weight disposed about the medical and lateral aspects of the foot provides resistance and balance exercise to the small muscle groups around the ankle joint, such as, the Extensor Digitorum Longus, Extensor Hallucis Longus, Anterior Tibialis, Peroneal group (Longus, Brevis and Tertius), Posterior Tibialis, Flexor Digitorum Longus and Flexor Hallucis Longus muscles. The instant device may also be worn about either foot and ankle, wherein right and left hand devices are not required. It is also fastened in such a manner that it may be quickly and easily attached about and removed from the foot and ankle of the wearer.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 3 is a vertical section taken substantially at line 3—3 of FIG. 1;

FIG. 4 is a vertical section taken substantially at line 4—4 of FIG. 1;

FIG 5 is an enlarged vertical section taken substantially at line 5—5 of FIG. 1, showing a typical cross section of one leg of the instant device without weight material for clarity;

FIG. 6*a* is a side elevational view showing one side of the instant device fastened in place about the ankle and foot of a wearer; and FIG. 6*b* is a side elevational view showing the other side of the instant device fastened in place about the ankle and foot of the same wearer.

DESCRIPTION OF THE PREFERRED EMBODIMENT

Figures 1, 2:
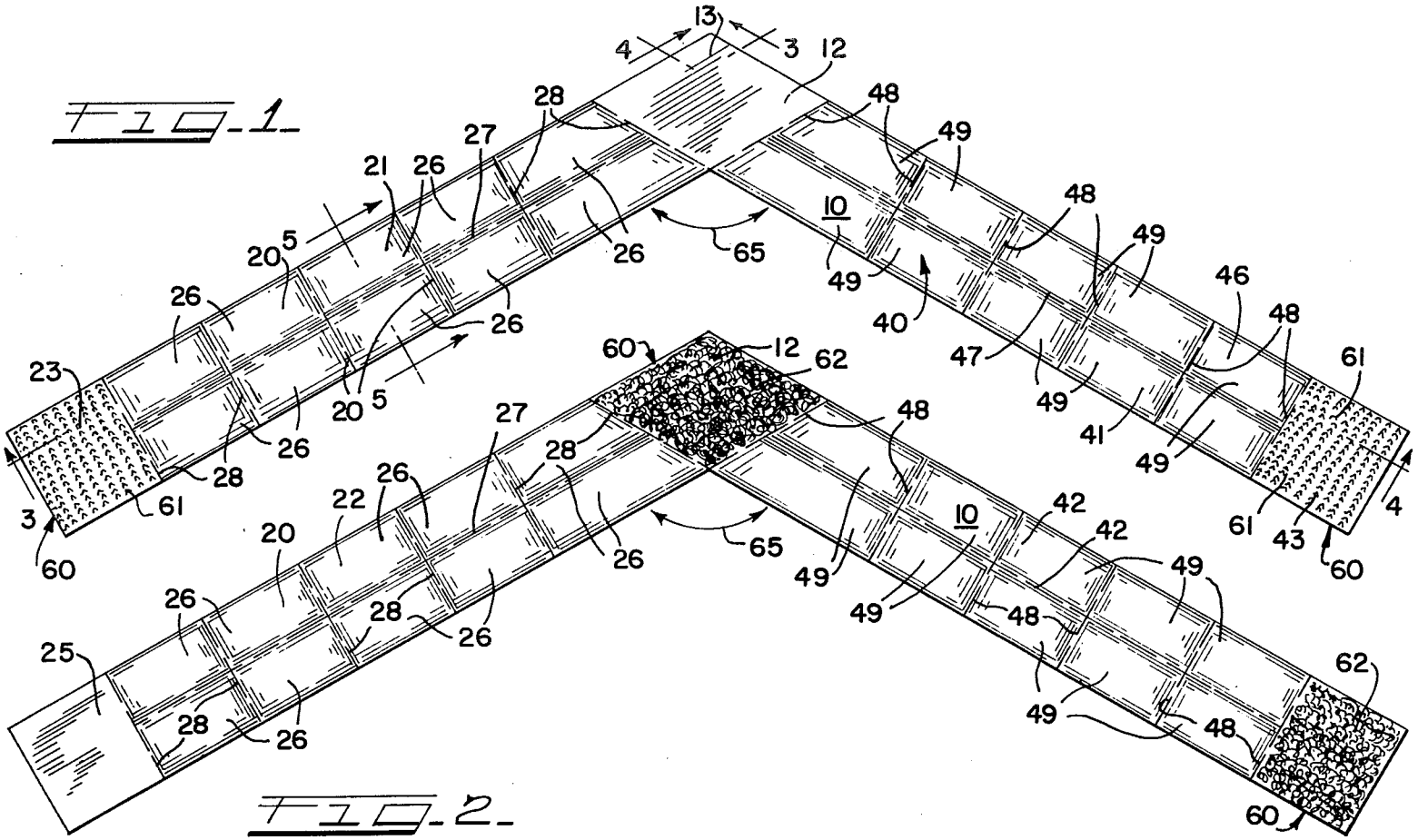
FIG. 1 is a front elevational view of the instant device embodying the instant invention showing it in extended position.
FIG. 2 is a rear elevational view of the same device showing it in extended position.

Turning attention to FIGS. 1 and 2, the device embodying the instant invention is designated by numeral 10. The device 10 comprises a pair of legs or elongate members generally designated 20 and 40, respectively, which meet or join at a common apex section 12 to provide a V-shaped configuration to the device 10. The legs or members each have a same general construction and design, however, depending on a particular use or adaptation one leg may be longer in length and/or receive more weight material the other. Furthermore, the legs 20 and 40 are constructed of a flexible material such as canvas, soft leather, naugahyde or the like. If necessary, a particular material could be treated to provide water resistant properties to the device 10 as a whole.

As best seen in FIGS. 1, 2 and 3, the leg or member 20 has a generally elongated, rectangular and flattish configuration defining opposing side walls 21 and 22. At one end of leg 20 the side walls 21 and 22 join and are affixed or secured to one another to form the flat apex section 12. This flat apex section 12 has a configuration generally in the shape of a parallelogram and includes oppositely disposed surface area 13 and 14.

At the other and free end of leg 20 the side walls again join and are affixed or secured together to form a flat and a generally rectangularly shaped flexible end portion having oppositely disposed surfaces 24 and 25 respectively.

Between the common apex section 12 and the end portion 23 of leg 20 is an elongate, compartmentalized enclosure 26. The walls 21 and 22 are joined and secured together to form a lenthwise seam 27 along a centrally disposed longitudinal line lying substantially on the longitudinal axis of the leg 20. Also walls 21 and 22 are affixed and secured together along a plurality of spaced apart cross seams generally designated 28 to form a plurality of enclosed compartments or pockets generally designated 29. During fabrication weight means 50 comprising particle or granule weight material, such as lead shots or beads are received or placed in each compartment 29 in a substantially uniform manner. This provides that the enclosure 26 is substantially uniform in weight and yet quite flexible for wrapping about an ankle or foot.

FIG. 4 together with FIGS. 1 and 2 show the leg 40. As stated before, the leg 40 has the same general design as leg 20. The leg 40 comprises an oppositely disposed side walls 41 and 42. At one end of leg 40 the side walls are joined, affixed and merge to form the flat apex section 12. At the other and free end of leg 40 again are secured together to form a flat and flexible end portion 43 having a generally rectangular shape and oppositely disposed surfaces 44 and 45. Located between the apex section 12 and the end portion 43 of leg 40 is an elongate enclosure 46 comprising an aggregate of enclosed compartments or pockets 49. These pockets 49 are formed by securing or affixing the walls 41 and 42 together along a centrally located seam 47 lying on longitudinal axis of the leg 40 and also by joining and affixing the walls 41 and 42 together along spaced apart cross seams generally designated 48. Again, during fabrication of leg 40, granular or particle weighty material is placed or received uniformly in each compartment 49 to provide that the enclosure 46 is substantially uniform in weight along its length and also flexible for easy wrapping about a foot or ankle.

FIG. 5 shows a leg 20 in cross section taken substantially normal to the longitudinal axis thereof. It is in this Figure that inside seam 30 can be seen. It can be appreciated that one method of constructing either leg would be to fold the material about and join the same at the ends thereof at the seam 30. Therefore, this FIG. 5 also suggests and illustrates the design and construction of leg 40.

Fastening means generally designated 60 are disposed on the various surfaces of the apex section 12 and the end portions 23 and 43 of the legs 20 amd 40 respectively. It is contemplated that such fastening means 60 comprise hook, loop or burr means 61 and fibrous means 62 which when placed in mating relation and forced together removable engage to provide a releasable fastener, such as Velcro materials. On the instant device the hook or loop means are disposed and secured and affixed on the surfaces 24 and 44 of the end portions of legs 20 and 40 respectively. The fiberous means 62 are disposed and affixed and secured to the surface 14 of the apex section 12 and the surface 45 of the end portion 43 of the leg 40. It can be appreciated that other fastening structures well known in the art could be employed.

It is intended that the walls of legs 20 and 40 be affixed and secured together to form the end portions and compartments thereof and the apex section 12 by sewing or stitching with nylon thread or other suitable materials well known in the art. Also the fastening means 60 would also be secured in a like manner to the various surfaces of the end portions of the legs and apex section as described hereinbefore. However, other means employing adhesives, chemical, welding or other forms or methods of securing one material to another would be used depending on the material used to construct the device 10.

FIGS. 6*a* and 6*b* illustrate and suggest application of the instant device 10. It is first pointed out that, as stated before, the legs 20 and 40 join or meet at the apex section 12 to form a flattish, flexible S-shaped structure and defining an angle 65 between said legs 20 and 40. This angular relationship is important in that upon wrapping one of the legs of the device 10 about the foot or ankle of a wearer the other leg of the same device will automatically align in dispositional relation with the remaining unwrapped portion of the wearer, whether it be the foot or ankle. It has been found the angle 65 having a quantity of approximately 120 degrees provides that angular relationship between the legs 20 and 40 to effect this feature of automatic alignment.

In application the device 10 is placed on the wearer such that the surface 13 of the apex section 12 lies on the anterior of the foot as suggested in FIGS. 6*a* and 6*b*. The surface 14 on which the fibrous means 62 has been secured face outwardly. The leg 40 of the device 10 is then wrapped about either the ankle or foot whereupon the hook or burr means 61 secured to the surface 44 of the end portion 43 thereof will register with the fibrous means 62 on the apex 12. These are then forced together in order that the burr means 61 on surface 44 of the leg 40 firmly embeds itself into the burr or hoop means 61 on the apex section 12 to effect a releasable fastening thereat. Now at that same location the fibrous means 62 on the surface 45 of leg 40 faces outwardly. The leg 20 is there wrapped about the remaining same foot or ankle whereupon the loop or burr means 61 on the surface 24 of that leg aligns and registers with fibrous means 62 the surface 45 of leg 40 and is secured and fastened thereof as described hereinbefore. It is contemplated that the lengths of leg 20 and 40 would be constructed such that alignment and registering of the fastening means 60 on the apex section and end portions of the legs would occur as explained above. It is noted that the anterior of the foot is unweight. However, weight is disposed about the ankle and the medial and lateral aspects of the foot to provide resistance and balance exercise to various muscle groups of the wearer as explained hereinbefore. When this device 10 is worn by skaters strengthening these muscle groups will assist with improved balance and coordination as a precursor for better and proper use of both the inside and outside edges of the skate blade while skating. Through the use of the skate weight, overall power and endurance of the larger muscle groups of the lower limb will be improved concurrently with the improvement in strength and coordination of the smaller finer control muscles of the foot and ankle joints.

It will be appreciated that the embodiment of the invention has been chosen for the purposes of illustration and description herein is that preferred based upon requirements for achieving the objects of the invention and developing the utility thereof in a most desirable manner. It will be understood that the particular structure and functional aspect emphasized herein are not intended to exclude but rather to suggest other such modifications and adaptions as fall within spirit and scope of the invention as hereinbefore described.

What is claimed is:

1. A weighted exercising device for wrapping about the foot and ankle of a wearer comprising:

first and second elongate and flexible members joined at a common apex section and having free end portions spaced apart from said common apex section, said members disposable in an angular relationship with each other to effect V-shape configuration therebetween for wrapping said members about the foot and ankle of the wearer;

weight means disposed along the length of said members;

releasable fastening means disposed on said apex section and on each said free end portion of each said member to effect a securing of one of said members about the ankle and the other said members about the foot of the wearer; and each said member has a longitudinal dimension to effect alignment of said fastening means on said apex section and said end portions at a common location to effect said securing thereat.

2. The invention according to claim 1 wherein each of said members comprising a plurality of enclosed compartments, and said weight means comprising granular weighty material confined within each said compartment.

3. The invention according to claim 2 wherein said compartments of each member are disposed between said common apex section and said free end portion of each said member respectively.

4. The invention according to claim 1 wherein said releasable fastening means comprising first and second means providing removable engagement with each other.

5. The invention according to claim 4 wherein said first fastening means comprise a fibrous grasping material and said second means comprise a plurality of elements embedable into said first means and graspable thereby, and said material and said elements selectively disposed on said apex section and said end portions in such a manner that said material and said elements thereon registering in mating relation at said common location.

6. A V-shaped exercising device for wearing about the foot and ankle of a wearer comprising:

first and second elongate and flexible legs each having a longitudinal length greater than its width;

said legs meeting at a common apex section in an angular relation to define an included angle therebetween having a quantity less than 180 degrees, and each of said legs having a free end portion disposed in spaced relation to said common apex section;

weight means disposed along the length of each said leg; and fastening means disposed on said apex section and on said free end portions of each said leg for releasably affixing one said leg about the ankle and said other leg about the foot of the wearer and securing each of said free end portions to said apex section.

7. The invention according to claim 6 wherein each said leg comprises an enclosure having a plurality of pockets disposed between said apex section and said free end portion of each said leg, and said weight means comprising particulate weighty material captured within said pockets.

8. The invention according to claim 6 wherein said included angle has a quantity of substantially 120 degrees.

9. The invention according to claim 6 wherein each said leg has oppositely disposed flexible side walls, and said walls on each said leg are affixed and joined together at the end portions thereof to form a flat, flexible segment thereat, and said walls are joined and affixed together at said apex section wherein said section has a flexible, flat form.

10. The invention according to claim 9 wherein said fastening means is disposed on said flat segment of the end portion of each leg and said apex section.

11. The invention according to claim 10 wherein the length of each said leg has a dimension to effect an alignment of said fastening means at a common location on the foot of the wearer.

12. The invention according to claim 6 wherein said releasable fastening means comprising a first fibrous grasping means and a second means having elements embedable into said first means for removable engagement therewith, and said first and second means selectively disposed on said apex section and on said flat segments of each end portion of each leg in such a manner that said first and second means thereon register in mating relation for fastening engagement at said common location.

* * * * *